US006300732B1

(12) United States Patent
Brambilla

(10) Patent No.: US 6,300,732 B1
(45) Date of Patent: Oct. 9, 2001

(54) DUAL POWER UNIT FOR MOVEMENT OF A BACK AND FOOTREST IN ARMCHAIRS AND THE LIKE

(75) Inventor: Massimo Brambilla, Inzago (IT)

(73) Assignee: Compact S.r.l. (IT)

( * ) Notice: Subject to any disclaimer, the term of this patent is extended or adjusted under 35 U.S.C. 154(b) by 0 days.

(21) Appl. No.: 09/555,286

(22) PCT Filed: Nov. 13, 1998

(86) PCT No.: PCT/EP98/07338

§ 371 Date: May 30, 2000

§ 102(e) Date: May 30, 2000

(87) PCT Pub. No.: WO99/27819

PCT Pub. Date: Jun. 10, 1999

(30) Foreign Application Priority Data

Dec. 2, 1997 (IT) ..... M1900859

(51) Int. Cl.[7] ..... H02P 7/10

(52) U.S. Cl. ..... 318/9; 318/7; 318/8; 180/6.5; 180/65.1; 180/65.2; 280/250.1; 297/73; 297/423

(58) Field of Search ..... 318/7–9; 180/65.1, 180/65.2; 297/73, 423; 280/250.1

(56) References Cited

U.S. PATENT DOCUMENTS 3,596,154 * 7/1971 Gurwicz ..... 318/52
4,475,072 * 10/1984 Schwehr et al. ..... 318/602
5,044,647 * 9/1991 Patterson ..... 280/250.1
5,074,000 * 12/1991 Soltani et al. ..... 5/62
5,253,724 * 10/1993 Prior ..... 180/65
5,435,404 * 7/1995 Garin ..... 180/6.5
5,450,800 * 9/1995 Leonard ..... 108/7
5,667,035 * 9/1997 Hughes ..... 182/142
5,791,425 * 8/1998 Kamen et al. ..... 180/7.1
5,894,097 * 4/1999 Peter ..... 180/374
5,927,144 * 7/1999 Koch ..... 74/89.15
6,176,335 * 1/2001 Schaffner et al. ..... 180/65.1

FOREIGN PATENT DOCUMENTS

9417433 * 5/1995 (DE) ..... A47C/1/02
583 660-A1 * 8/1994 (EP) ..... A47C/20/04

* cited by examiner

*Primary Examiner*—Robert E. Nappi
*Assistant Examiner*—Tyrone Smith
(74) *Attorney, Agent, or Firm*—Shlesinger, Fitzsimmons & Shlesinger

(57) ABSTRACT

The dual power unit includes an elongate housing having mounted therein adjacent opposite ends thereof two power units, one of which is drivingly connected to the movable back of an armchair, and the other unit is connected to a movable footrest of an armchair. Each unit includes a pivotal shaft connected to the back or footrest of the armchair. Each such shaft is connected to the output shaft of an electronic motor reducer through a transmission-gear in the form of a screw extending transversely of the respective pivotal shaft. The screw is drivingly connected through a threaded slider which is in engagement with a pair of cam elements mounted on a respective pivotal shaft to impart pivotal movement thereto, and consquent movement to the portion of the armchair connected thereto.

7 Claims, 3 Drawing Sheets

DUAL POWER UNIT FOR MOVEMENT OF A BACK AND FOOTREST IN ARMCHAIRS AND THE LIKE

The present invention relates to a power unit of the type employed for movement of a back and a footrest in armchairs and the like.

Known in the art are power units called "dual motors" which are formed of a generally elongated rectangular casing comprising, at the inside thereof, two motor reducers and two transmission-gears for rotation of a pair of movement shafts. Connected to one of these shafts is the kinematic movement mechanism of the armchair back and to the other of said shafts the kinematic movement mechanism of the armchair footrest.

Accomplishment of the power units is made complicated by the fact that they must be very powerful, strong and compact.

In the art it has been proposed that the transmission-gear between each motor reducer and the movement shaft should be accomplished by means of a mechanical piston formed of a screw connected to the motor reducer, and the free end of which is received in a sliding element. In this way, upon rotation of the screw, the screw-slidable element assembly is made longer and shorter. The movement shaft is integral with a cam which is disposed in a plan coincident with the screw axis and bearing on the head of the sliding element. In this manner on lengthening and shortening of the piston, the movement shaft rotates. An example of these devices is disclosed by EP-A-0 583 660.

A drawback of such a structure is that the piston, in order to supply a sufficient rotation angle of the movement shaft, must nearly double its length when it passes from the retracted condition to the completely extended condition. For the above reason the longitudinal sizes of the power unit are relatively high. In addition, even when a greater rotation angle would be preferable, this is not possible because it would involve accomplishment of a too long power unit, incompatible with the armchair sizes.

It is a general object of the present invention to obviate the above mentioned drawbacks, by providing a compact, cheap and strong power unit enabling high rotation angles with a reduced bulkiness to be obtained.

In view of the above object, in accordance with the invention, a dual power unit has been devised for movement of a back and a footrest in a power-driven armchair comprising an elongated casing which, close to each end, has a transverse-movement shaft which is connected to a shaft of an electric motor reducer through a transmission-gear, the transmission-gear comprising a screw connected to the shaft of the motor reducer and extended transversely of the movement shaft and longitudinally of the casing and a threaded slding slider into which the screw is screwed down, cam means being integral with the movement shaft and bearing on the slider for converting the sliding movement of the slider along the screw into an angular-rotation movement of the DE-U 94 17 433 discloses a power unit, wherein a crank-rod mechanism converts the linear movement of a slider rotational movement of the shaft. movement shaft, characterized in that the screw thoroughly crosses the slider and in that the cam means comprises two cam elements laterally projecting from the movement shaft for resting on thrust surfaces provided on the slider, on opposite sides of the screw.

For better explaining the innovatory principles of the present invention and the advantages it offers as compared with the known art, a possible embodiment of the invention applying said innovatory principles will be given hereinafter, by way of non-limiting example, with the aid of the accompanying drawings. In the drawings.

Figure 1:
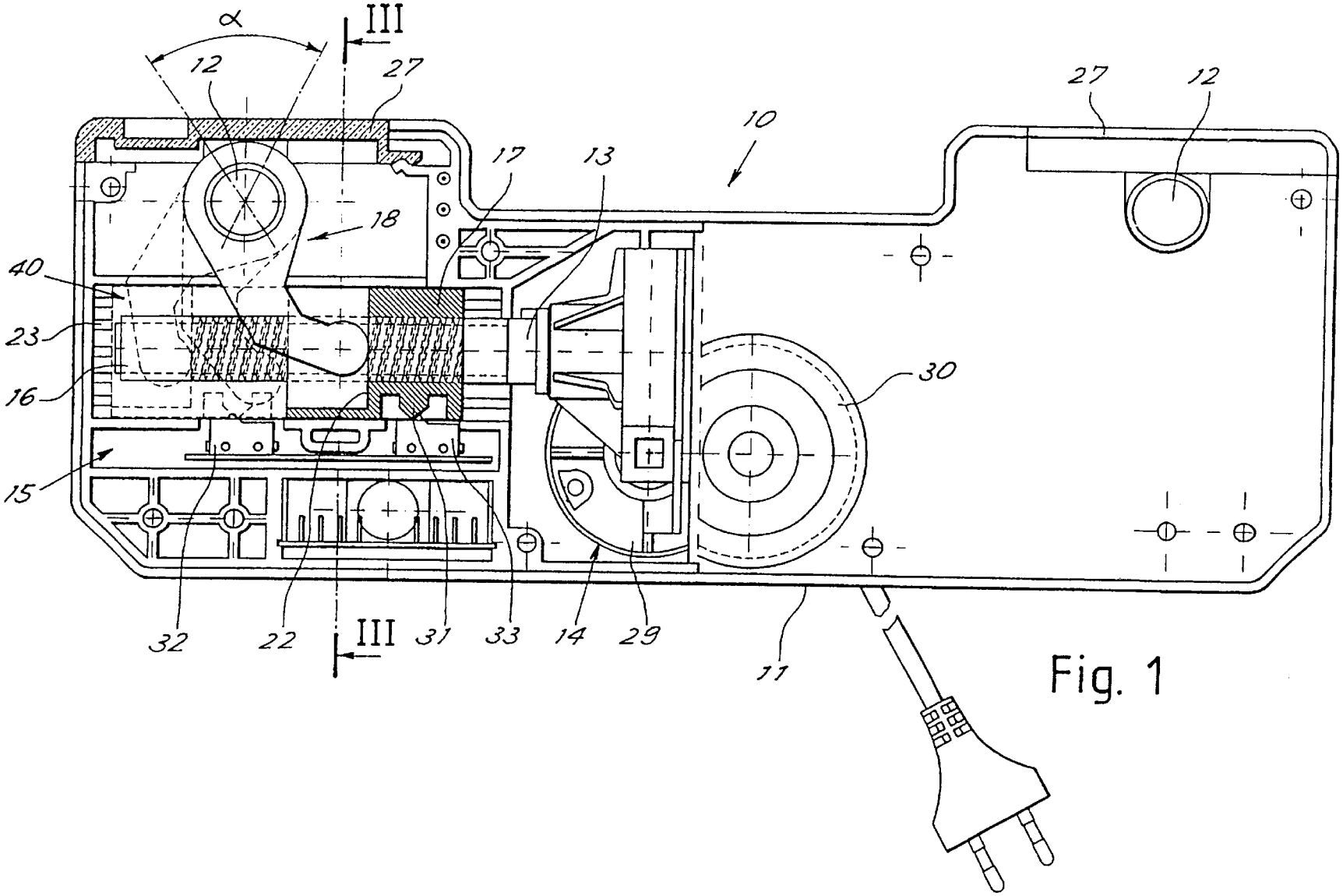
FIG. 1 is an elevation side view partly in section of a power unit in accordance with the invention.

With reference to the drawings, a dual power unit, generally denoted by 10, comprises an elongated casing 11 which, close to each end, has a transverse-movement shaft 12. The two movement shafts 12 are parallel to each other. Through a transmission-gear 15 the two movement shafts 12 are each connected to the shaft 13 of an electric motor reducer 14. The motor reducers advantageously have electric motors 29, 30 extending in an axis transverse to the casing and in opposite directions with respect to each other, on the two casing sides.

Only one of the two transmission-gears is herein shown and described because the assembly formed of the motor reducer, transmission-gear and output or movement shaft 12 is reproduced in mirror image relationship relative to a median transverse plane of the casing and the two transmission-gears are therefore symmetrical in respect of this plane.

As clearly viewed from FIG. 1, the transmission-gear 15 comprises a screw 16 axially connected to the motor reducer shaft 13 and extended transversely of the movement shaft and longitudinally of the casing. The transmission-gear further comprises a threaded sliding slider 17 into which a screw is screwed down. Screw 16 thoroughly crosses slider 17.

Cam means 18 is integral with the movement shaft 12 and bears on the slider to convert the sliding movement of the slider along the screw into an angular-rotation movement of the movement shaft.

Figure 2:
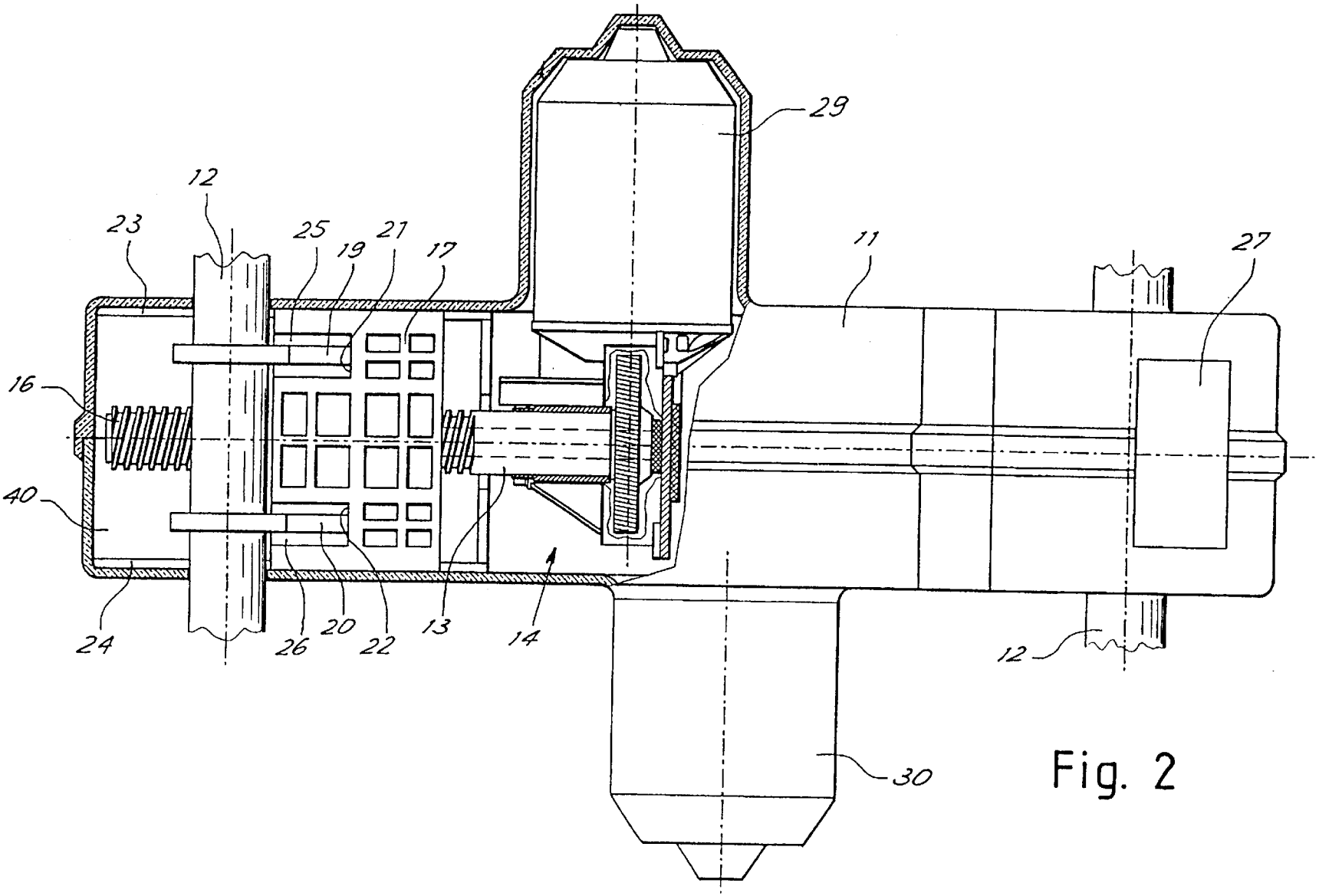
FIG. 2 is a plan view partly in section of the power unit shown in FIG. 1.
Figure 3:
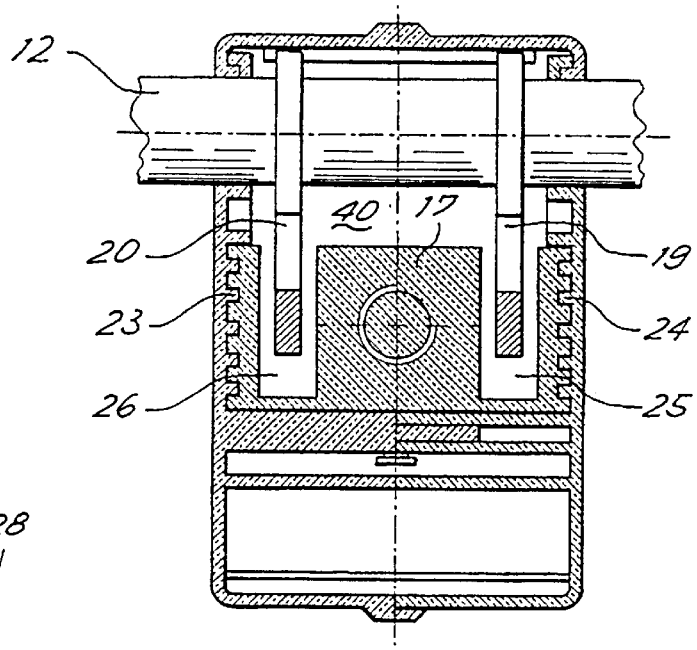
FIG. 3 represents a cross-sectional view taken along line III—III in FIG. 1.
Figure 4:
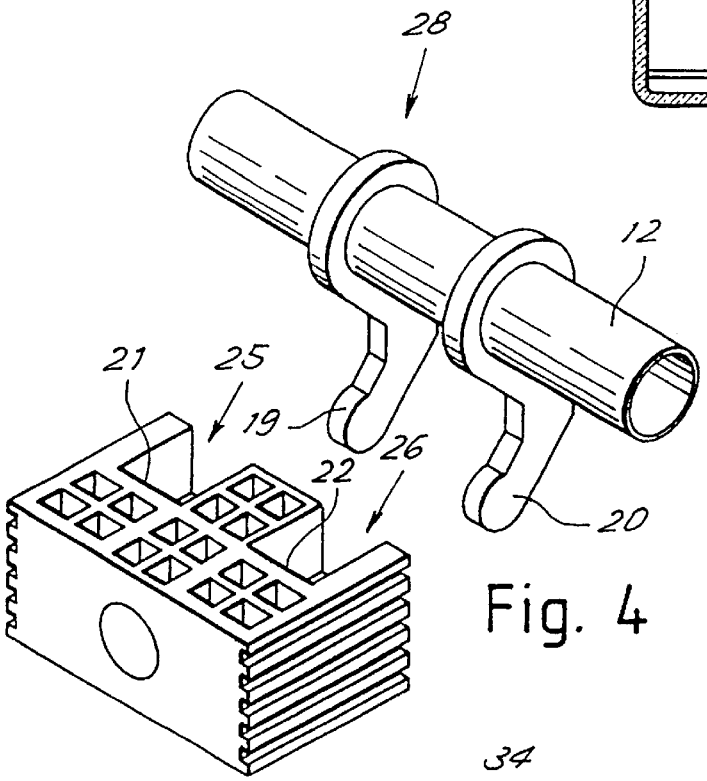
FIG. 4 is a perspective view of two parts of the power unit shown in FIG. 1.

As clearly shown also in FIGS. 2–4, the cam means comprises two cam elements 19, 20, laterally projecting from the movement shaft 18 for resting on thrust surfaces 21, 22 that are provided on the slider on opposite sides of the screw. The free ends of the cam elements are rounded off in the rotation plane. Advantageously, the straight line joining the two contact points between the surfaces 19, 20 and the cam head passes through the screw axis, so that the operating effort can be applied along the screw axis itself.

The thrust surfaces 21, 22 are bottom walls of seatings 25, 26 in the slider receiving the free ends of the cam elements. As shown in FIG. 1, the seatings are open on top and at the sides to enable the free movement of the cam elements resting on surfaces 21, 22. The cam elements have their free end generally bent in a direction parallel to the screw and towards the thrust surface.

As clearly viewed from FIG. 3, the slider slides in a seating or cavity 40 in the casing, laterally guided by a plurality of parallel matching ribs 23, 24 present on side walls of the slider and seating. The ribs define a plurality of parallel grooves. Ribs provided on the slider fit into grooves provided in the seating and vice-versa. It has been found that this enables an excellent sliding without any lubrication being required and in addition there is a high resistance to rotation and no jamming occurs.

The casing, for each shaft 12 may comprise a closeable opening 27 disposed laterally of the movement shaft for radial removal therefrom of said shaft and the cam elements integral therewith forming a cam assembly 28, as shown in FIG. 4.

As shown in FIG. 1, the slider can have an element 31 for operation of a pair of end-of-stroke or limit microswitches 32, 33.

Figure 5:
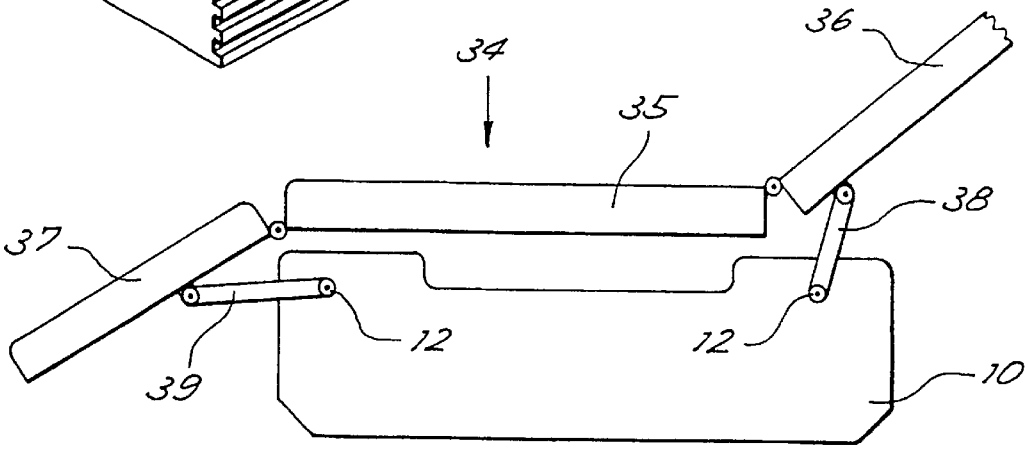
FIG. 5 is a diagrammatic elevation side view of an armchair incorporating the power unit shown in FIG. 1.

Diagrammatically shown in FIG. 5 is an armchair 34 having a base seat 35 with a back 36 and a footrest 37 hinged thereon. The armchair is comprised of a power unit 10 the shafts 12 of which control movement of the back and footrest by means of kinematic mechanisms 38, 39.

At this point it is apparent that the intended purposes have been achieved, by providing a very compact power unit, above all as regards length, while at the same time furnishing a high rotation angle. For example, the power unit shown can have a rotation angle a of about 60° with a stroke of the slider of about 5 cm and an overall length of the power unit of only 40 cm.

Obviously, the above description of an embodiment applying the innovatory principles of the present invention is given for purposes of illustration only and therefore must not be considered as a limitation of the scope of the invention as herein claimed.

For example, the proportions of the different parts can vary depending on practical requirements. Advantageously the slider may be obtained by moulding of a plastic material.

What is claimed is:

1. A dual power unit for movement of a back and a footrest in a power-driven armchair, comprising an elongated casing (11) which, close to each end, has a transverse-movement shaft (12) which is connected to a shaft (13) of an electric motor reducer trough a transmission-gear (15), the transmission-gear comprising a screw (16) connected to the shaft (13) of the motor reducer and extended transversely of the movement shaft (12) and longitudinally of the casing and a threaded sliding slider (17) into which the screw is screwed down, cam means being integral with the movement shaft and bearing on the slider for converting the sliding movement of the slider along the screw into an angular-rotation movement of the movement shaft, characterized in that the screw (16) thoroughly crosses the slider (17) and in that the cam means comprises two cam elements (19, 20) laterally projecting from the movement shaft for resting on thrust surfaces (21, 22) provided on the slider, on opposite sides of the screw.

2. A power unit as claimed in claim 1, characterized in that the slider (17) slides in a seating (40) in the casing, being laterally guided by a plurality of parallel matching ribs (23, 24) present on the side walls of the slider and the seating.

3. A power unit as claimed in claim 1, characterized in that the thrust surfaces in the slider are bottom walls of seatings (25, 26) in the slider receiving the ends of the cam elements.

4. A power unit as claimed in claim 1, characterized in that the ends of the cam elements resting on the thrust surfaces are rounded off, and in that a straight line joining the two contact points between the thrust surfaces (19, 20) and cams passes through the screw axis.

5. A power unit as claimed in claim 1, characterized in that the casing comprises a closeable opening (27) disposed laterally of the movement shaft for radial removal therefrom of the movement shaft and the cam elements integral therewith.

6. A power unit as claimed in claim 1, characterized in that the motor reducer has an electric motor extending transversely of the casing.

7. A power unit as claimed in claim 1, characterized in that the two transmission-gears are symmetrical relative to a median transverse plane of the casing.

* * * * *